US006419816B1

(12) United States Patent
Lyublinski

(10) Patent No.: US 6,419,816 B1
(45) Date of Patent: Jul. 16, 2002

(54) CATHODIC PROTECTION OF STEEL IN REINFORCED CONCRETE WITH ELECTROOSMOTIC TREATMENT

(75) Inventor: Efim Ya. Lyublinski, Mayfield, OH (US)

(73) Assignee: Cor/Sci, LLC., Cleveland, OH (US)

( * ) Notice: Subject to any disclaimer, the term of this patent is extended or adjusted under 35 U.S.C. 154(b) by 0 days.

(21) Appl. No.: 09/761,388

(22) Filed: Jan. 16, 2001

Related U.S. Application Data

(60) Provisional application No. 60/241,232, filed on Oct. 18, 2000.

(51) Int. Cl.[7] ..... C23F 13/04

(52) U.S. Cl. ..... 205/734; 204/196.02; 204/196.03; 204/196.05; 204/196.06; 204/196.37

(58) Field of Search ..... 204/196.02, 196.03, 204/196.05, 196.06, 196.37; 205/734

(56) References Cited

U.S. PATENT DOCUMENTS 5,225,058 A * 7/1993 Bazzoni et al. ..... 204/196.02
5,228,959 A * 7/1993 Miller ..... 205/734
5,368,709 A * 11/1994 Utklev ..... 205/734
6,126,802 A 10/2000 Utklev ..... 204/515
6,238,545 B1 * 5/2001 Allebach ..... 205/734
6,270,643 B1 * 8/2001 Finnebraaten ..... 204/515

* cited by examiner

*Primary Examiner*—Bruce F. Bell

(57) ABSTRACT

Combining an electroosmosis direct current (EP) applied at less than 1 mA/Mcm$^3$ (milliamp per 1000 cm$^3$ of concrete) with an anode placed adjacent an outer surface of reinforced concrete soaked with a substantially neutral saline solution, effectively depletes corrosive anions in the concrete even when the direct current is in the range from 0.01 mA to less than 1 mA and at a voltage less than 100 V. Further, using such electroosmotic treatment as a first treatment, and promptly following it with cathodic protection, preferably by an impressed cathodic current (CP) at a comparably low voltage, the current density of CP required for cathodic protection is unexpectedly reduced. This decrease in the required current density of impressed current CP, coupled with low installation and operational costs of the novel system, improves the efficiency of a conventional cathodic protection system, whether by impressed current or with sacrificial anodes, several fold, as high as by a factor of 3 to 30 times. Both processes may be operated together without one circuit interfering with the other.

5 Claims, 4 Drawing Sheets

CATHODIC PROTECTION OF STEEL IN REINFORCED CONCRETE WITH ELECTROOSMOTIC TREATMENT

This application claims the benefit of Provisional Application No. 60/241,232 filed Oct. 18, 2000.

BACKGROUND OF THE INVENTION

Intermittent or continuous methods of inhibiting the corrosion of steel contained in concrete structures are described. The equipment necessary to effect these methods can be incorporated into the structure during construction or retrofitted to existing structures. Cathodic protection systems are routinely used in the art, and it is known that electroosmosis will change the concentration of ions in the environment subjected to sufficient current to generate the electroosmotic effect. By "electroosmotic effect" is meant the movement of ions in water along the surface of solid concrete particles in a concrete structure.

This application is directed to a system which combines electroosmotic removal of corrosive anions from concrete and the cathodic protection of metal members embedded in concrete, such as in footings of steel bridges, the bases of communications towers, and more particularly, to the protection of reinforcing concrete members referred to as "rebars" in conventionally reinforced concrete structures. Such rebars are produced from mild steel (also referred to as "black steel") which has less than 1% carbon and less than 2% of alloying elements, combined. Removal of ions such as chlorides was taught by Slater, J. E. in an article titled Electrochemical Removal of Chlorides from Concrete Bridge Decks in "Materials Performance" November 1976, pp 21–26. An electric field was applied between the reinforcement and an electrolyte on the concrete surface with the reinforcement as the negative pole. The chloride ions migrate through the concrete and either react with the electrolyte or are oxidized at the anode to chlorine gas which is evolved. Cathodic protection is typically effected either with (a) sacrificial anodes, or (b) impressed current with (i) potential control or (ii) current control, the reinforcement being the reactive cathode and the anode being substantially inert. Contamination of the concrete results in reaction of the cathode with the contaminants, and of course there is oxidation of the steel.

Typically reinforced steel structures such as bridges, buildings including power stations, marine structures such as docks, and roadways which are freshly built are most preferably immediately cathodically protected with an impressed current. But aged, internally reinforced and/or prestressed concrete structures which have been damaged because of chemical reaction with acidic elements in the ambient atmosphere cannot be adequately protected without first counteracting or eliminating the source of the problem causing the damage. The problem of protecting aged reinforced concrete structures is markedly different from cathodically protecting newly embedded rebars and other metal members in a concrete structure.

Though electroosmotic removal of corrosive anions from within aged and contaminated concrete, and, cathodic protection with either a sacrificial anode or an impressed current are routinely practiced, the effect of first using an electroosmotic current to deplete corrosive ions in concrete, then protecting the reinforcing members in the anion-depleted concrete with an impressed cathodic current was never considered. Neither was it considered to first use an electroosmotic current to deplete the corrosive ions, then without shutting off the electroosmotic current, concurrently providing an impressed cathodic current to protect the reinforcing members.

Improvements in the basic Slater process have been disclosed in U.S. Pat. Nos. 4,823,803; 4,865,702; 5,141,607; 5,228,959; inter alia. Electroosmotic current has also been used in porous concrete or masonry building materials, to transport water out of the material to minimize damage due to moisture. Typical of the technology dealing with concern about moisture in such materials, U.S. Pat. No. 6,126,802 teaches that the process comes to a stop due to the build-up of a potential on the electrodes. Thus the conditions under which direct current is applied to the material being treated, and apparently minor differences in composition and condition of the material being treated have a disproportionately large effect on the results of the treatment. The references do not suggest that for electroosmotic removal of corrosive anions the reinforcing members need not be the cathode, and that the electroosmotic current effectively depletes the anions in the concrete even when the electrolyte is a saline solution which is substantially pH neutral (pH 7–8); nor do the references suggest that, when the reinforcing members within the concrete are not used as the cathode, direct current usage is comparatively much lower; further, that as the ions within contaminated concrete are removed, it is unnecessary either to take core samples of the concrete, or, to analyze the electrolyte to analyze for the remaining corrosive ionic content of the concrete; moreover, there is no observed build-up of a potential on the electrodes and no pulsing required.

A system is provided for controlling corrosion of reinforced concrete which is contaminated with atmospheric pollutants such as sulfur oxides, nitrogen oxides, hydrogen sulfide, and road treatment salts such as sodium chloride and potassium chloride, all of which permeate the concrete structure and attack the steel rebars. This invention combines either (a) electroosmotic treatment with cathodic protection using a sacrificial anode, or, (b) electroosmotic treatment with cathodic protection using an impressed current. The former removes ions detrimental to steel and reduces the corrosivity of the environment surrounding the steel.

Since electroosmosis depletes the concentration of ions in the concrete environment thus increasing the resistivity of the concrete, it would be logical to conclude that under such conditions the current required to maintain cathodic protection would increase; eventually the conductivity would be so low that the current density for cathodic current would be uneconomical and have to be discontinued. Therefore it was not evident that subjecting the reinforced concrete to an electroosmosis treatment would be likely to decrease the power requirements for maintaining adequate corrosion protection of the rebars.

To provide a basis for comparing the effect of combining processes in which the conditions are different, efficiency of the processes to combat corrosion is used as a common parameter. "Efficiency" is stated as being zero when there is no protection of any kind; efficiency is defined as the amount of metal which was not lost because of protection, divided by the amount of metal which would be lost with no protection, or:

(corrosion rate with no protection)−(corrosion rate with protection) divided by (corrosion rate with no protection).

The following terms are used in this disclosure:

"$E_c$" refers to the corrosion potential of the rebar. $E_c$ is measured with a reference electrode placed in contact with the circumferential surface of the concrete sample. It is written negative relative to a standard hydrogen electrode.

"$E_p$" refers to the potential at which an effective impressed current for cathodic protection is to be supplied.

"CD": current density for cathodic protection=current divided by the superficial area of the rebar in contact with concrete.

"CP": impressed current for cathodic protection, identified separately when different.

"EP": direct current for electroosmotic treatment which removes contaminant anions from the concrete;

"EL" refers to an aggressive, substantially neutral pH, saline solution which serves as electrolyte in which samples are immersed.

SUMMARY OF THE INVENTION

It has been discovered that combining an electroosmosis direct current (EP) applied at less than 1 mA/Mcm$^3$ (milliamp/1000 cm$^3$ of concrete), preferably less than 0.2 mA/Mcm$^3$ and voltage safe for humans, with the anode placed adjacent an outer surface of concrete soaked in a substantially neutral saline solution, effectively depletes corrosive anions in the concrete even when the direct current is in the range from 0.01 mA to less than 1 mA and at a voltage less than 100 V, preferably less than 70 V. Further, using such electroosmotic treatment as a first treatment until flow of current indicates depletion of harmful anions, and promptly, within less than six months, following the first treatment with cathodic protection, preferably by an impressed cathodic current (CP) at a comparably low voltage, the current density of CP required for cathodic protection is unexpectedly reduced. This decrease in the required current density of impressed current CP, coupled with low installation and operational costs of the novel system, improves the efficiency of a conventional cathodic protection system, whether by impressed current or with sacrificial anodes, several fold, as high as by a factor of 3 to 30 times. Moreover, though the electroosmotic treatment may be provided using the reinforcing members in the concrete as cathode, it is preferred to use a cathode outside the concrete structure; this "external" cathode for electroosmotic current (EP) is not the reinforcing members in the concrete.

It is therefore a general object of this invention to provide an electroosmotic treatment in combination with a cathodic protection system to enable one to maintain an aged ion-contaminated concrete structure essentially corrosion-free, using only a fraction of the current which would be required to maintain the same level of protection in a conventional cathodic protection system. Sequentially causing the electromigratory movement of contaminant ions out of the concrete, followed promptly by cathodic protection, and repeating the sequence as needed is effective. Concurrently providing both electroosmotic treatment and cathodic protection is unexpectedly even more efficient than sequential treatment, one circuit operating without substantially interfering with the other.

It is a specific object of the invention to provide a method for sequentially protecting, with separate electroosmotic and cathodic protection circuits, structures which are badly damaged due to the ravages of time in an acidic atmosphere. Electroosmotic treatment is commenced when resistance to direct EP current is low enough to allow more than about 1000 $\mu$A/Mcm$^3$ to flow at 36 V. EP is turned off when the current flow decreases to about 200 $\mu$A/Mcm$^3$ which indicates that the concentration of ions has dropped to an acceptably low level. The impressed cathodic current CP is turned on at a safe level of less than 100 V to maintain a potential $E_p$ at a desired level, typically in the range from about 150 mV to less than 300 mV higher (numerically, though written as negative volts relative to a hydrogen electrode) than the corrosion potential of the rebars. CP is maintained until the current density rises above a level deemed economical. For example, when the current density rises above about 300 mA/m$^2$ the costs of cathodic protection are generally deemed uneconomical; operation is preferably with current density of CP not above 200 mA/m$^2$. CP is turned off when it is deemed uneconomical, and the circuit for electroosmotic treatment is then reactivated until enough ions are removed to make cathodic protection with impressed current CP alone, economical. This alternating sequence may be repeated as often as necessary to keep corrosion of the metal to a tolerable minimum over an indefinite period of time. The concentration of salts in the concrete is sensed by measurement of the current density required at a chosen safe voltage, and no analysis is required to determine the content of ions remaining in the concrete. Control of the system is effected with a programmable control means associated with a power source.

Alternatively, the electroosmotic treatment and cathodic protection of a chlorinated and sulfonated concrete structure may be commenced substantially concurrently by providing two separate electrical circuits which operate concurrently with separate anodes and cathodes until the levels of the electroosmotic current and the impressed cathodic current are too high to be economical. Thereafter only cathodic protection using either a sacrificial anode, or, an impressed current having lower current density, is necessary for adequate cathodic protection.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which:

FIG. 1(*b*) schematically illustrates a conventional cathodic protection system with a sacrificial anode buried in the ground outside the concrete structure.

FIG. 1(*c*) schematically illustrates a conventional cathodic protection system with plural sacrificial anodes buried in the concrete structure.

FIG. 3(*b*) schematically illustrates a sacrificial anode protection system in which a soluble anode is used for the dual purposes of providing the necessary circuit for cathodic protection, and also to provide the necessary circuit to provide electroosmotic treatment of the concrete.

FIG. 4(*b*) is a graph plotting corrosion rate ($\mu$m/year) as a function of current density given in mA/m$^2$ (milliamps/square meter) using conventional impressed cathodic current on reinforced concrete samples immersed in a substantially pH neutral solution.

DETAILED DESCRIPTION OF PREFERRED EMBODIMENTS

Figure 1A:
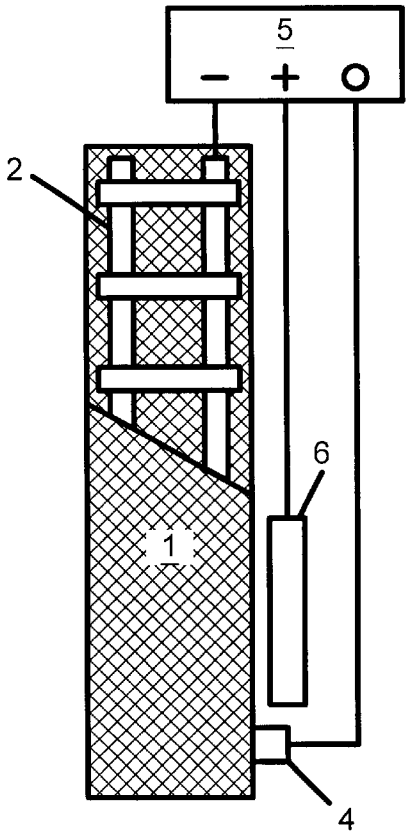
FIG. 1(a) PRIOR ART
FIG. 1(*a*) schematically illustrates a conventional cathodic protection system with impressed current, a reference electrode being used to measure potential for the rebars.

When an acid, base or salt is dissolved in water or any other dissociating solvent, a part or all of the molecules of the dissolved substance are broken up into ions some of which are charged with positive electricity and are called cations, and an equivalent number of which are charged with negative electricity and are called anions. Freshly poured, moist concrete has mainly $Ca^+$ and $OH^-$ ions. In an aged concrete structure, acidified with the typical environmental contaminants, the contaminant anions are chiefly $SO_4^=$ or $SO_3^=$, $CO_3^=$ and $Cl^-$; neither the $OH^-$ anions, if present, nor the $Ca^{2+}$ or $H^+$ cations are harmful. Because electroosmotic treatment with direct current causes an equivalent of beneficial cations to leave the anode for each equivalent of anions removed from the concrete, the direct current is effective to "cleanse" badly contaminated concrete.

Cathodic protection with impressed current together with electroosmotic treatment are now used to remove corrosive species such as chloride, sulfate and sulfite from the bulk of the reinforced concrete by first using an externally applied current between an exterior cathode and an exterior anode for electroosmotic treatment of the concrete; this is preferably done at as high a voltage as deemed safe and allowable, and as high a current as is required at the chosen voltage for the resistivity of the concrete. For safety considerations the voltage chosen is preferably non-injurious to a human, preferably in the range from 10 to 70 V, preferably 30 to 50 V. The current required under typical conditions is small, typically less than 1 mA, and preferably less than 0.1 mA, in the range from about 200 to 1000 $\mu$A/Mcm$^3$ concrete, depending upon the degree of contamination; the more contaminated, the higher the current. When the concentration of harmful anions is greatly decreased, the current typically drops below 200 $\mu$A/Mcm$^3$.

Aluminum or aluminum-rich alloy rods, or magnesium and magnesium-rich alloy rods, zinc and zinc-rich alloys are used as sacrificial anodes proximately disposed or embedded within the structure in galvanic connection with the steel rebars; or zinc-coated rebars are used; in either case, the required mass of the anode is the amount of metal which goes into solution over time, this amount of metal being the amount of electricity flowing through the galvanic circuit and the time over which the metal is consumed (Faraday's law). Since protection is sought over an extended time, and the rate of consumption of the anode is typically quite high once corrosion commences, the required mass of sacrificial anode for the long period, say 100 years, is high. Moreover, periodic replacement of anodes to provide continuous protection is inconvenient at best and often impractical. Therefore use of such sacrificial anodes has been largely discontinued in favor of using an external power supply to provide an impressed cathodic current to the corrodible metal. By controlling the impressed current the service life of the structure is not limited by corrosion of its steel reinforcement.

In cathodic protection, an impressed current is caused to flow through the anode into the electrolyte and then to the rebars in the structure. Such protection with the steel rebars as the cathode, as conventionally practiced, is expensive, requiring a much higher current density to obtain a satisfactorily low level of corrosion than that required to obtain the same corrosion protection with rebars in an environment which has been depleted of corrosive ions. When the level of corrosive anions in the concrete is low it is found that the current density of the impressed current is low, being less than about 100 mA/m$^2$; as the concentration of corrosive ions increases the current density increases; when it reaches about 200 $\mu$A the impressed current is discontinued and the electroosmotic current is switched on.

Figure 1B:
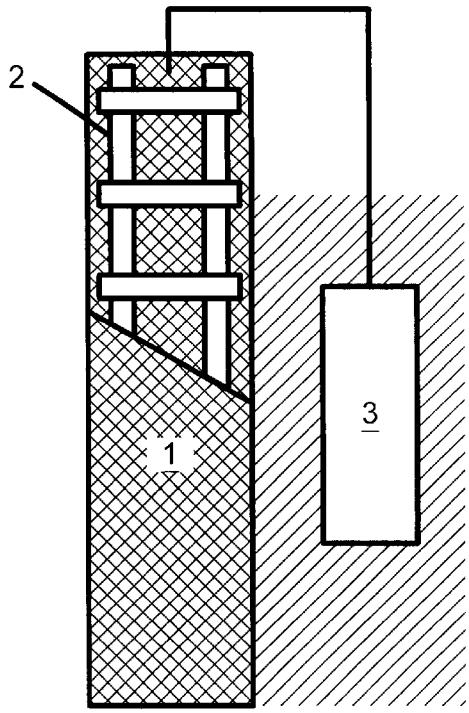
FIG. 1(b) PRIOR ART
Figure 1C:
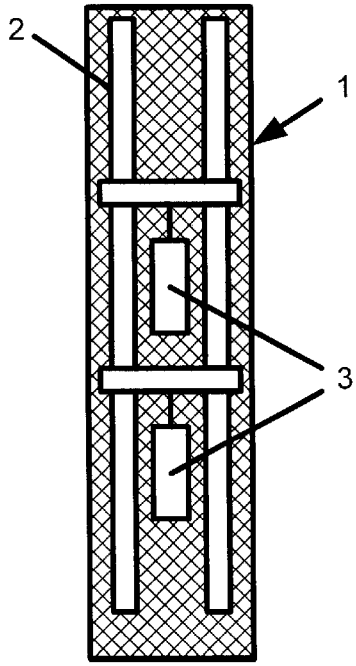
FIG. 1(c) PRIOR ART

Referring to FIGS. 1(*b*) and 1(*c*) a conventional cathodic protection with a sacrificial anode includes rebars 2 embedded in a concrete column 1 with a sacrificial anode 3 externally positioned in FIG. 1(*b*) and buried in the concrete in FIG. 1(*c*). Either of these systems is generally not as effective as with an impressed current because of the low power output. The cause of lower output is a low voltage or potential difference between the sacrificial anode and the corroding steel in concrete in a saline environment. The potential is typically less than 1 volt and often as little as 0.5 volt. Since concrete has a higher resistivity than a typical wet soil, up to about 100,000 ohm-cm, the resistance of the circuit is hundreds or thousands of ohms. With high resistivity the current output is low.

In a conventional impressed current system, using the one shown in FIG. 1(*a*), rebars 2 embedded in the concrete column 1 are connected as cathode to a power station 5 to which an external inert anode 6 is also connected. Reference electrode 4 is placed on the surface of the concrete column.

The corrosion rate with no current (no protection) is about 450 $\mu$m/yr; when the current density is 200 mA/m$^2$ the corrosion rate is about 20 $\mu$m/yr, which is negligible. Thus, to get an efficiency of about 95% the current density required is 200 mA/m$^2$, efficiency being defined as the corrosion rate at a specified current density divided by the corrosion rate with no current. To obtain about 80% efficiency one requires a current density of about 120 mA/mm$^2$. The novel system avoids the high cost of such conventional protection.

Figure 3A:
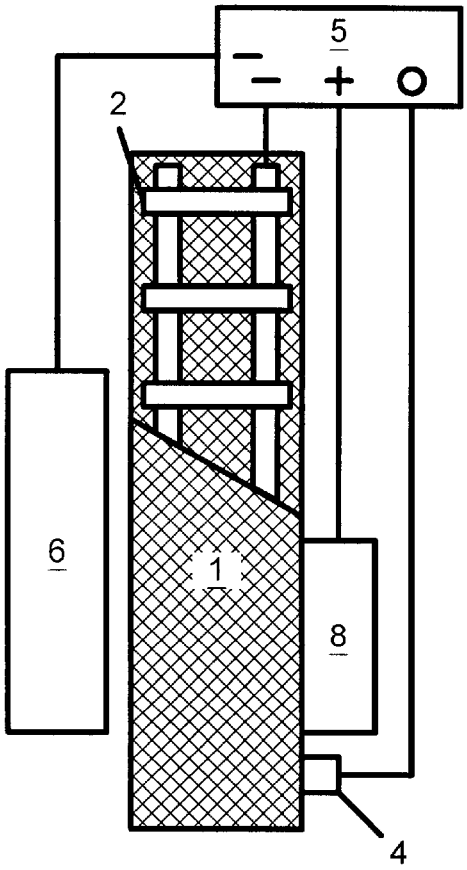
FIG. 3(*a*) schematically illustrates an impressed current cathodic protection system in which an essentially inert, insoluble anode is used for the dual purposes of providing the necessary circuit for cathodic protection, and also to provide the necessary circuit to provide electroosmotic treatment of the concrete.
Figure 3B:
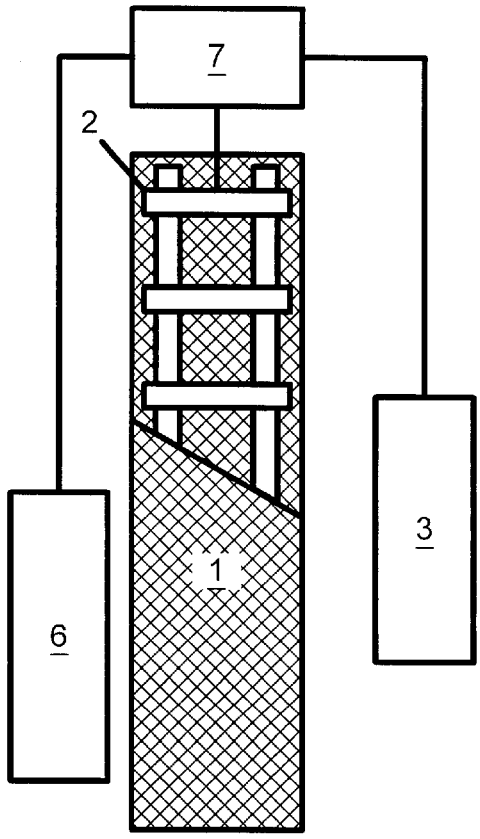

Though a sacrificial anode system of FIG. 1(*b*) may be used in combination with an external cathode as shown in FIG. 3(*b*) it is not as effective as the impressed current system. In FIG. 3(*b*) rebars 2 reinforce a concrete column 1 and an external anode 3 is connected to a control system 7; an external cathode 6 is also connected to the control system 7. The low power output of the system makes it less effective than an impressed current system.

Therefore, an impressed current cathodic protection system such as is shown in FIG. 1(*a*) is preferred, combined with an additional cathode as shown in FIG. 3(*a*). In each of FIGS. 3(*a*) and 3(*b*) the reference electrodes are not shown, to avoid confusion.

The novel corrosion protection system is typically used on aged structures which are badly damaged by acidic contaminants. Electroosmotic treatment is commenced until the concentration of corrosive contaminants is depleted to a satisfactory level as evidenced by the current (EP) decreasing to a current density of less than 200 $\mu$A, preferably less than 100 $\mu$A; then the current is switched off. Promptly thereafter, preferably within less than six months, most preferably within less than one month, cathodic protection is provided with impressed current at a current density deemed economical, and the impressed current is maintained until the build-up of contaminants is deemed deleterious. Thereafter, electroosmotic treatment is repeated.

When used with new construction, cathodic protection is most preferably provided with impressed current until the build-up of contaminants is deemed deleterious. Promptly thereafter, preferably within less than six months, electroosmotic treatment is commenced until the concentration of corrosive contaminants is depleted to a satisfactory level.

Most preferably, the electroosmotic treatment and cathodic protection are carried out concurrently, comprising, cathodically connecting a first cathode to a source of potential which is sufficiently electronegative to provide electroosmosis of ions within said concrete, the first cathode being exteriorly proximately disposed relative to said concrete structure; maintaining electroosmotic transfer of ions from said concrete until the conductivity of said concrete is so low as to reach a current density of about 200 $mA/m^2$ or less; cathodically connecting the rebars to a source of electronegative potential sufficient to provide enough impressed current to repress the cathodic potential of said rebars to within a predetermined range; anodically connecting said source of potential to an anode proximately disposed relative to said rebars; and, maintaining current from the source of electronegative potential at a potential in the range from about 150 mV to less than 300 mV numerically higher than the corrosion potential of said corrosion potential sensing member until the current density rises to more than 100 $mA/m^2$. Preferably the corrosion potential at the surface of the rebars relative to a reference electrode on the surface of the concrete is continuously measured.

A programmable control means associated with the source of power monitors and is responsive to a sensing means embedded in, or on the surface of the concrete structure, or both, to provide data as to the corrosion potential at the rebars, the pH of the concrete and the concentration of salts at different locations within the structure.

A system for the maintenance of a concrete structure reinforced with steel rebars essentially free from corrosion of the rebars, comprises, a mass of concrete wherein the rebars are electrically interconnected in a grid; an external power source responsive to a programmable control means to which data is transmitted from a sensing means, connected in serial relationship, the programmable control means being responsive to both the external power source and the sensing means; means for anodically connecting the external power source of potential to an anode proximately disposed relative to said rebars; means for cathodically connecting a first cathode to the external power source which provides sufficient current to establish an electroosmotic flow of ions out of the concrete; means for cathodically connecting the rebars to said external power source which is sufficiently electronegative with respect to the measured stable potential to repress the cathodic potential of the rebars to within a predetermined range; and, means for maintaining current from the source of electronegative potential at a potential in the range from about 150 mV to less than 300 mV numerically higher than the corrosion potential of the corrosion potential sensing member.

For operation in the sequential (first) mode with impressed current CP, the system illustrated in FIG. 3(*a*) is operated as follows:

The power supply 5 is connected to the cathode 6 buried in the earth next to the concrete column 1, and also connected to the insoluble anode 8 which is adjacent the concrete, most preferably in contact with the concrete surface. Sufficient current at 36 V is used to obtain electroosmosis which draws $Cl^-$ and other anions to the anode 8, while $Na^+$ and other cations migrate to the cathode 6. Measurements with the reference electrode track the corrosion potential ($E_c$) of the rebars during both electroosmotic treatment and cathodic protection.

When the resistivity in the concrete column is still high enough to permit EP to flow at a relatively low current, about 200 $\mu$A preferably less than 100 $mA/m^2$, the cathode 6 is disconnected from the power supply 5 so that electroosmosis is discontinued, and the rebars 2 are connected to the negative terminal of power supply 5. The period during which each step will be required to be carried out will vary depending upon the environment of the rebars in the concrete and the characteristics of the substantially pH neutral soil around the column.

For sequential operation with a sacrificial anode, the negative terminal of the control system 7 is connected to the cathode 6 buried in the earth next to the concrete column 1, preferably in contact with its surface, and the positive terminal in 7 is connected to the soluble sacrificial anode 3. Sufficient current EP is used to obtain electroosmosis which draws $Cl^-$ and other anions to the anode 3, while $Na^+$ and other cations migrate to the cathode 6. As before, when the flow of current EP is low enough, it is turned off. The rebars are then connected to the negative terminal in the control system 7 and cathodic protection is provided by the sacrificial anode 3. The sequence may be repeated as needed, as before.

Using either an impressed current CP or a sacrificial anode, it is found that the same corrosion rate is obtained with a current density of less than about half that required with a conventional cathodic protection system, whether it uses impressed current cathodic protection, or a sacrificial anode.

For operation in the concurrent (second) mode, the systems illustrated in FIGS. 3(*a*) and 3(*b*) the electroosmotic current EP is maintained while the cathodic protection circuit provides galvanic connection between the rebars and an anode. When impressed current CP is used in combination with EP two separate circuits operate simultaneously in a substantially pH neutral common medium.

Each numbered sample is a reinforced concrete cylinder having a diameter of 10 cm and a height of 20 cm, prepared using 300 Kg of Portland cement per cubic meter of concrete, in the center of which cylinder was longitudinally axially embedded a clean rust-free carbon steel rod 1.5 cm in diameter and 25 cm long. Each rod in each sample was weighed before it was embedded. Also embedded in each sample, proximate to the central rod, is a pH electrode to monitor the pH as a function of time. After each run, the top of each rebar, which provides electrical connection as a second cathode, is cut off essentially flush with the top of the concrete to minimize the error due to corrosion of the top portion being exposed directly to the corrosive elements in the conditioning chamber without benefit of being covered by concrete.

To accelerate atmospheric damage which normally would be expected to occur over a period of decades, all the samples are pre-conditioned over a period of 30 days in a conditioning chamber provided with an aggressive synthetic atmosphere. The corrosive atmosphere in the conditioning chamber has the following composition:

chloride, $Cl^-$: 1.5 $g/m^2 \times hr$ (measured on the surface of the cylinder)

sulfur dioxide $SO_2$: 30 $mg/m^3$ relative humidity, RH: 100% chamber temperature: 55° C.

Corrosive $Cl^-$ ions are provided by continually spraying a NaCl solution into the chamber over the 30 days. The concentration of NaCl on the surface of the sample is measured from time to time, typically every 2 hr. The $Cl^-$ ion concentration is calculated on the basis of the surface area of the sample and maintained constant over the 30 days. The concentration of sulfur dioxide gas is maintained constant over the 30 days. The effect of aging in the conditioning chamber is assessed by measuring pH as a function of time in each of the samples, which pH is found to vary in the ranges indicated, from sample to sample, during each period in the ranges set forth as follows in Table 1 below:

TABLE 1

| Day # | 1 | 10 | 20 | 30 |
|---|---|---|---|---|
| pH | 12.0–13.4 | 7.6–9.1 | 7.4–8.3 | 6.8–8.0 |

The samples are thereafter tested to determine the corrosive effect of EL, under specified protective conditions, by immersing them in the electrolyte.

The electrolyte EL is prepared by dissolving the following salts in distilled water so that their concentrations, given as g/L, are NaCl, 25; $MgCl_2$, 2.5; $CaCl_2$, 1.5; $Na_2SO_4$, 3.4; and $CaCO_3$, 0.1, and its pH is 7–8.

Figure 2:
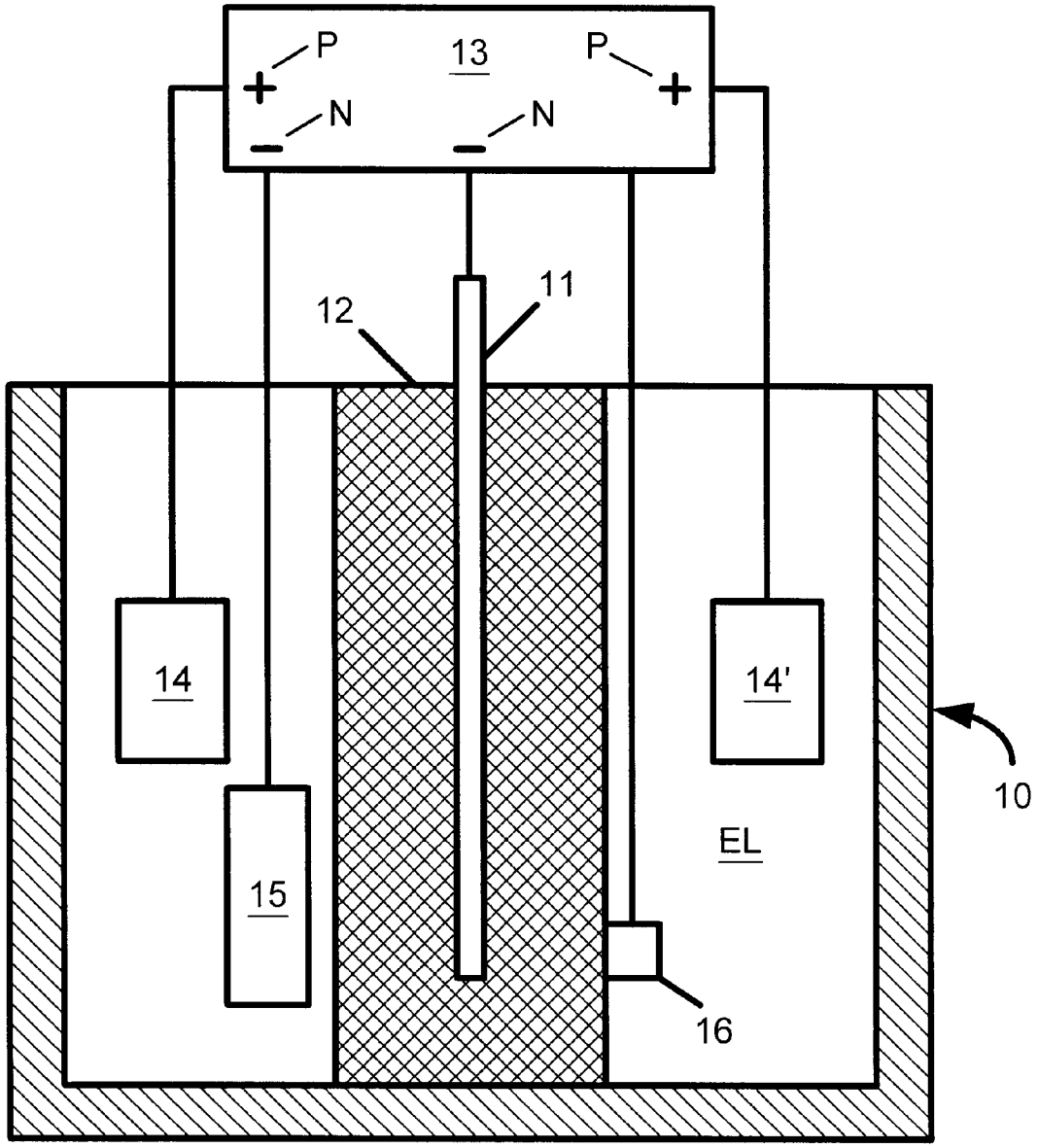
FIG. 2 schematically illustrates a container in which experiments were conducted with samples of rebar-reinforced concrete.

Referring to FIG. 2 there is illustrated an electrically non-conductive plastic container 10 filled with electrolyte EL in which a reinforced concrete sample 12 is centrally disposed with the top of rebar 11 protruding from the upper surface of the sample. The rebar 11 functions as a cathode (referred to herein as the second cathode) and is connected to the negative terminal N in a power station 13. The top of the rebar is essentially flush with the top of the concrete to minimize the error due to corrosion of the top portion being exposed directly to the corrosive elements in the conditioning chamber without benefit of being covered by concrete, the top of the rebar being sufficient to provide electrical connection as a second cathode. Anodes 14 and 14' are suspended in the electrolyte on either side of the sample and connected to separate positive terminals P and P' in the power station 13; a first cathode 15 is also suspended in the electrolyte, spaced apart from the surface of the sample, and like the second cathode, also connected to the negative terminal in the power station. Each pair of terminals provides current for circuits which serve different purposes, one for cathodic protection and the other for electroosmotic treatment.

In a first embodiment of the invention, the circuits are used sequentially, the EP current being used to deplete the concentration of corrosive ions in the concrete, switching it off, then providing protection with the cathodic impressed current until the current density rises to a level deemed uneconomical; the EP current is then switched on. A reference electrode 16 is placed in contact with the circumferential surface of the sample and connected to the power station to measure the reference corrosion potential $E_c$ of the rebar. After only three days $E_c$ is difficult to measure meaningfully but after about 10 days it is found to be about—360 mV and remains substantially constant irrespective of in which sample the rebar is embedded. The $E_c$ is reported relative to a standard hydrogen electrode.

In a first series of experiments, the corrosive effect of the electrolyte is measured on samples at the end of 10, 140 and 180 days in the container 10, when there is no protection against corrosion by the electrolyte in which each sample is immersed; $E_c$ is measured every day. The corrosive effect is measured by removing a sample at the end of a specified period, say 10 days, fracturing it to remove the rebar, then cleaning the rebar to remove all adhering concrete and rust. The cleaned rebar is then weighed and the weight loss computed. Knowing the circumferential area of the clean rebar and adding the circular area of its top and bottom surfaces each 1.0 cm in diameter, the weight loss per $cm^2$ is computed. Then, taking the density of steel as 7.9 g/cc, and knowing the period over which the corrosion occurred, the corrosion rate is computed and given as the thickness of metal lost, $\mu$m/year.

The results are set forth in Table 2 below:

TABLE 2

| corrosion rate with no protection | | | |
|---|---|---|---|
| Day, # | $-E_c$ (mV) | Corrosion Rate $\mu$m/year | Efficiency |
| 10 | 360 | 385 | 0 |
| 140 | 355 | 210 | 0 |
| 180 | 360 | 220 | 0 |

As might be expected, the corrosion rate is much higher after 10 days than it is after 140; and the rate after 180 days is not much higher than it is after 140 days. The testing was discontinued after 180 days as the corrosion rate appeared to have reached a substantially constant average rate of about 220 $\mu$m/year.

Efficiency is stated as being zero since there is no protection.

In the second series of experiments, to measure the effect of electroosmotic treatment produced by an electroosmotic current, each freshly preconditioned concrete sample is placed in the container 10 and held there for 10 days during which time $E_c$ is measured every day. After 10 days, and a reliable measurement of $E_c$, an electroosmotic treatment current EP is turned on to remove as much of the ions in the concrete as can be removed while maintaining the voltage of the EP current at 36 V and allowing EP to vary accordingly. This voltage at which current measurements for electroosmotic treatment are to be made is arbitrarily chosen as being 36 V because this low voltage is not dangerous to humans. The effect of EP starting with the end of the first day on which it is turned on are recorded. The results are set forth in Table 3 below:

TABLE 3

| corrosion rate with EP current, no cathodic protection | | | | |
|---|---|---|---|---|
| Day No. | EP $\mu$A | $-E_c$ mV | Corr. rate $\mu$m/year | Eff. % |
| 1 | 700–800 | 320 | 165 | 25 |
| 5 | 300–400 | 320 | 105 | 52 |
| 10 | 100–200 | 280 | 70 | 68 |
| 180 | 50–100 | 320 | 45 | 79 |

As might be expected, because the concentration of salts is initially high the amount of EP current flowing at 36 V is high, 700–800 $\mu$A. After 10 days enough of the corrosive ions are removed from the concrete to moderate the EP current flowing in the range 100–200 $\mu$A in which range the corrosion rate is 70 $\mu$m/yr; and after 180 days the amount of EP current flowing at 36 V has diminished to 100–200 $\mu$A in which range the corrosion rate is 45 $\mu$m/yr. It is evident that over a period of 170 days the corrosion rate has not yet been reduced in half and further improvement in the corrosion rate will be much slower than in the early portion of the 180 day period. However, the amount of EP current flowing after a period of only 10 days is about one-fifth of the initial current (avg. initial current is 750 $\mu$A; after 10 days, avg. current in 150 $\mu$A).

In the third series of experiments, to measure the effect of conventional cathodic protection alone after cleansing with EP, each freshly preconditioned concrete sample is placed in the container 10 and held there for 10 days during which time $E_c$ is measured every day. After 10 days, an impressed cathodic current CP is then turned on at the stated $E_p$, reported as negative millivolts relative to the hydrogen electrode, to provide the rebar with cathodic protection. The values of $E_c$ and $E_p$ given are those measured after 180 days. The results are set forth in Table 4 below:

TABLE 4 corrosion rate with cathodic protection

| Day No. | $-E_c$ (mV) | $-E_p$ (mV) | CD mA/m$^2$ | Corr. rate $\mu$m/year | Eff. % |
|---|---|---|---|---|---|
| 180 | 355 | 385 | 20 | 167 | 28 |
| 180 | 335 | 390 | 40 | 132 | 40 |
| 180 | 350 | 415 | 60 | 94 | 57 |
| 180 | 340 | 465 | 120 | 41 | 81 |
| 180 | 355 | 520 | 200 | 11 | 95 |

As might be expected, the corrosion rate after 180 days is much higher at a lower current density than it is at a higher current density. The impressed cathodic current CP was turned off after the current doubled (consumption of current increased by a factor of 2). This level of increased CP current was chosen arbitrarily based on economic considerations; where the cost of current is low, the factor chosen may be 3 or higher. This relatively high current (doubled) which is typically still economic, provides a current density of 200 mA/m$^2$ at which the corrosion rate is 11 $\mu$m/yr. This rate is found to be acceptable because, on a real time scale, it corresponds to about 50 years. Since the corrosion rate after 180 days without protection is 220 $\mu$m/yr, the efficiency is calculated as(220−11)/220 which is 95%.

To show the effect of using electroosmotic treatment for only a short time, sufficient to remove some of the corrosive ions but which will leave enough ions in the concrete to make subsequent cathodic protection surprisingly effective, a fourth series of experiments is conducted. In this fourth series, to measure the effect of cathodic protection after only as much removal of ions as 10 days of EP current will provide, each sample is subjected to a 36 V electroosmotic current as were the samples in the second series of experiments.

The EP is turned off after the samples are partially depleted of corrosive ions over the 10 day period, and they are then subjected to an impressed current CP for cathodic protection over 180 days. The corrosion potential $E_c$ during each period is measured with the reference electrode. The results are set forth in Table 5 below:

TABLE 5 corrosion rate with cathodic protection after 10 days EP

| Day No. | $-E_c$ mV | $-E_p$ mV | CD mA/m$^2$ | Corr. rate $\mu$m/year | Eff. % |
|---|---|---|---|---|---|
| 180 | 305 | 425 | 35 | 32 | 85 |
| 180 | 310 | 480 | 55 | 9 | 96 |

It is now seen that, with an initial "cleaning" of the ions from the preconditioned concrete by electroosmotic treatment, subsequent cathodic protection at essentially the same level as in the third series of experiments (see Table 4) provides substantially the same corrosion rates, but at much lower current density. For example, with cathodic protection in Table 4 at a current density of 120 mA/m$^2$ the corrosion rate is 41 $\mu$m/yr; but with an initial "cleaning" of 10 days, and then providing cathodic protection with an impressed current density of only 35 mA/m$^2$, one gets substantially the same corrosion rate of 32 $\mu$m/yr. Stated differently, essentially the same high level of protection is afforded with a current density about 3.5 times smaller than otherwise required, for unexpected savings in cost of operation.

The foregoing method of treating contaminated concrete comprises, supplying the structure's surface with a substantially neutral electrolyte; applying a first direct current between steel in the structure and an electrode disposed adjacent an outer surface of the structure to cause ions to migrate to the electrode until flow of current is substantially constant; discontinuing the first direct current; applying an impressed cathodic current until it rises to an uneconomical level, and, repeating the first step. This sequence may be repeated for an arbitrarily long time. It is evident that using a cycle of treatment commencing with an initial electroosmotic treatment for a relatively short time, followed by cathodic protection with impressed current until it doubles, a corrosion rate of as little as 11 $\mu$m/yr may be maintained indefinitely at a current density as low as 200 mA/m$^2$.

In a second embodiment of the invention it is found that both EP and CP currents may be used concurrently. Though the current flowing between one pair of electrodes may have a slight effect on the current flowing through the other pair, the two currents are essentially independent of one another. As before, the contaminated samples are first subjected to an EP current at 36 V until it reaches a low level indicating a major portion of the corrosive ions in the concrete have been removed from the concrete. Then, instead of switching off the EP current before switching on the CP current (as in the first embodiment), the CP current is switched on while the EP current is left on. Data are provided for CP supplied at two different levels when the EP reaches levels of 100 $\mu$A and 50 $\mu$A. As before, $E_c$ recorded below is measured with the reference electrode at the end of the 180 day period. The results are set forth in Table 6 below:

TABLE 6 corrosion rate with concurrent EP and CP currents

| Day No. | EP $\mu$A | $-E_c$ mV | $-E_p$ mV | CD mA/m$^2$ | Corr. rate $\mu$m/year | Eff. % |
|---|---|---|---|---|---|---|
| 180 | 100 | 360 | 470 | 22 | 32 | 85 |
| 180 | 100 | 360 | 530 | 36 | 10 | 95 |
| 180 | 50 | 305 | 420 | 30 | 24 | 89 |
| 180 | 50 | 310 | 470 | 40 | 7 | 97 |

It is evident from the foregoing that concurrent utilization of EP and CP currents provides substantially the same or lower corrosion rates than those obtained with sequential application and at lower current density.

The foregoing method of treating a steel-reinforced concrete structure comprises, supplying the structure's surface with a substantially neutral electrolyte, applying a first direct current between steel in the structure and an electrode disposed adjacent an outer surface of the structure to cause ions to migrate to the electrode, and, concurrently applying an impressed cathodic current.

This system comprises, a mass of concrete wherein steel members are electrically interconnected; an external power source responsive to a programmable control means to which data is transmitted from a sensing means, connected in serial relationship. The programmable control means is responsive to both the external power source and the sensing means. The anode outside the structure, is proximately disposed relative to the steel and connected to the external power source. A first cathode is also connected to the external power source which provides sufficient current to cause migration of the ions and establish an electroosmotic flow of ions out of the concrete. The steel is cathodically connected to the external power source which is sufficiently electronegative with respect to said measured stable potential to repress the cathodic potential of the steel to within a predetermined range; and the power source maintains the impressed current from at a potential in the range from about 50 mV to less than 300 mV lower than the corrosion potential at said rebars.

The surprising effect of the improvement in economics for operating the system of this invention is graphically demonstrated by comparing the low current densities at which the novel system operates to provide excellent protection, with conventional cathodic protection which must be employed at high current densities which are economically impractical at this time, to get comparable protection. As seen in FIG. 4(*a*) plotting efficiency (%) as a function of current density given in $mA/m^2$ (milliamps/square meter), starting with no impressed current, a current density of 120 $mA/m^2$ is required to provide an efficiency of 81 (see Table 4). As seen in FIG. 4(*b*), as a function of at the same current density of 120 $mA/m^2$, corrosion rate is 41 mm/year. As seen in Table 6, comparable corrosion rates are obtained at much lower current densities.

I claim:

1. A method of treating a steel-reinforced concrete structure, comprising, (a) supplying the structure's surface with a substantially neutral electrolyte, (b) applying a first direct current between steel in the structure and an electrode disposed adjacent an outer surface of the structure to cause ions to migrate to the electrode until flow of current is substantially constant, (c) discontinuing the first direct current, (d) applying an impressed cathodic current until it rises to an uneconomical level, and, (e) repeating step (a).

2. The method of claim 1 including continuously measuring the corrosion potential at the surface of said rebars relative to a reference electrode.

3. The method of claim 1 wherein the impressed current is provided at a until the current density rises above 100 $mA/m^2$.

4. A method of treating a steel-reinforced concrete structure, comprising, supplying the structure's surface with a substantially neutral electrolyte, applying a first direct current between steel in the structure and an electrode disposed adjacent an outer surface of the structure to cause ions to migrate to the electrode, and, concurrently applying an impressed cathodic current.

5. A system for the maintenance of a concrete structure reinforced with steel members essentially free from corrosion of the members, the system comprising, a mass of concrete wherein the steel members are electrically interconnected;

an external power source responsive to a programmable control means to which data is transmitted from a sensing means, connected in serial relationship, the programmable control means being responsive to both the external power source and the sensing means;

means for anodically connecting the external power source of potential to an anode proximately disposed relative to the steel members;

means for cathodically connecting a first cathode to the external power source which provides sufficient current to establish an electroosmotic flow of ions out of the concrete;

means for cathodically connecting the steel members to the external power source which is sufficiently electronegative with respect to the measured stable potential to repress the cathodic potential of the steel to within a predetermined range; and, means for maintaining current from the source of electronegative potential at a potential in the range from about 50 mV to less than 300 mV lower than the corrosion potential at the steel members.

* * * * *

UNITED STATES PATENT AND TRADEMARK OFFICE

CERTIFICATE OF CORRECTION

PATENT NO. : 6,419,816 B1
DATED : July 16, 2002
INVENTOR(S) : Lyublinski

Figure 4A:
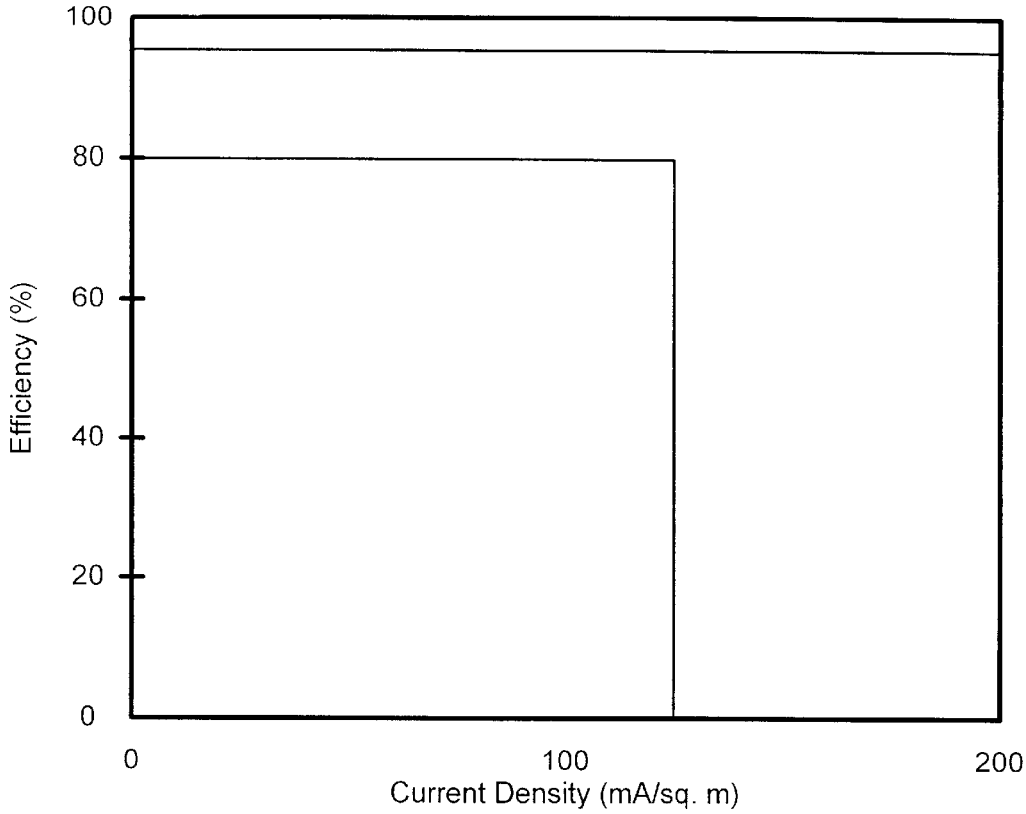
FIG. 4(*a*) is a graph plotting efficiency (%) as a function of current density given in mA/m$^2$ (milliamps/square meter), starting with no impressed current, using conventional impressed cathodic current on reinforced concrete samples immersed in a substantially pH neutral solution.
Figure 4B:
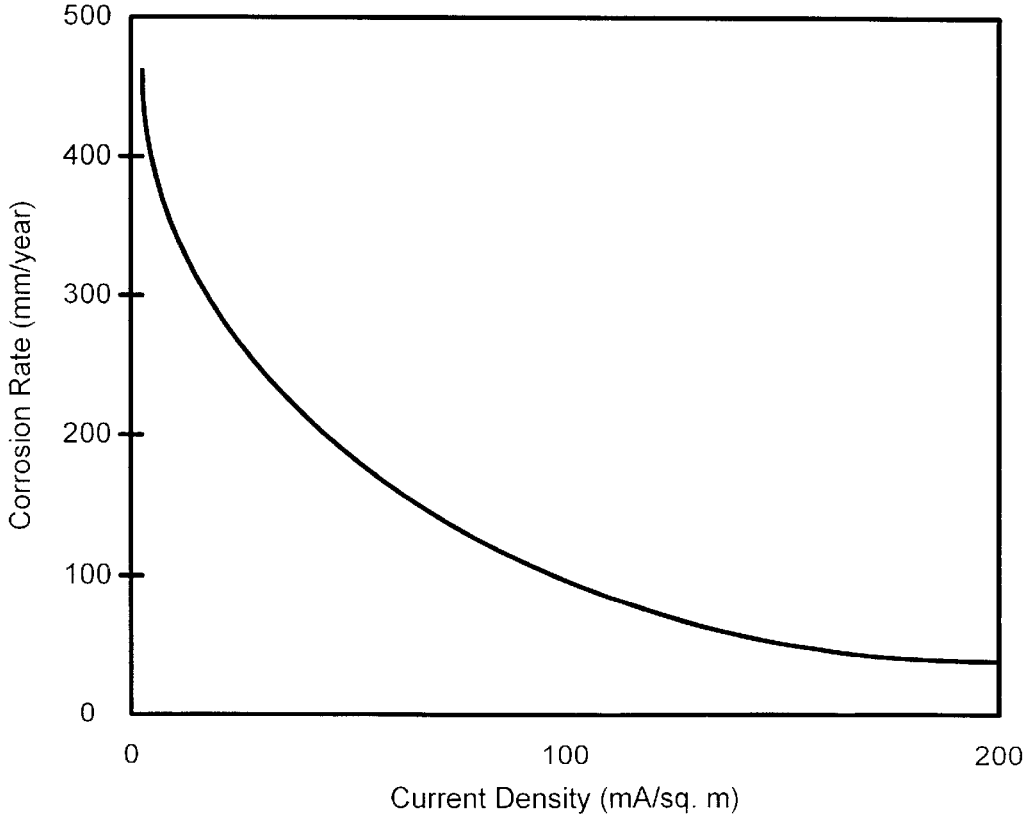

It is certified that error appears in the above-identified patent and that said Letters Patent is hereby corrected as shown below:

Drawings,
Replace Fig. 4(a) with the following:

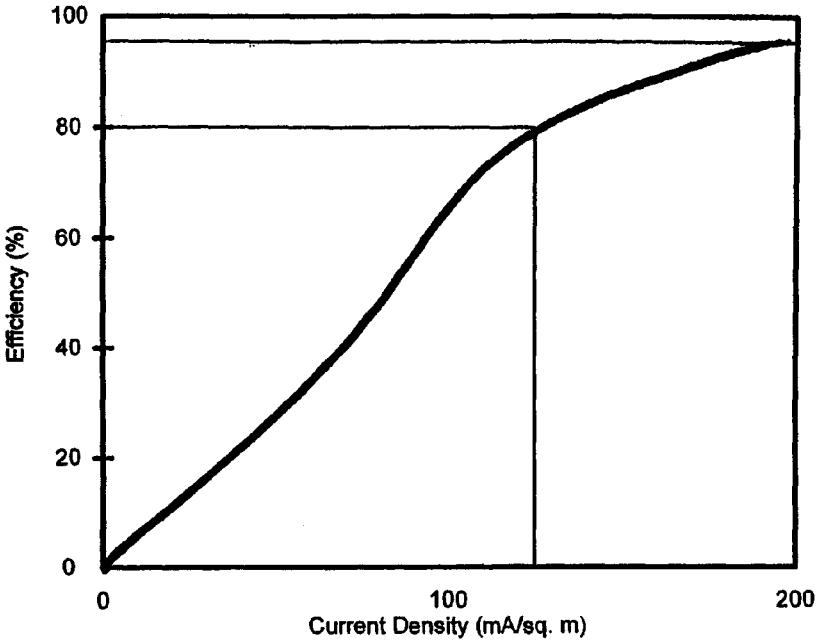

FIG. 4(a)

Signed and Sealed this

Twenty-fourth Day of December, 2002

JAMES E. ROGAN
*Director of the United States Patent and Trademark Office*